US006293650B1

(12) United States Patent
Sette et al.

(10) Patent No.: US 6,293,650 B1
(45) Date of Patent: Sep. 25, 2001

(54) IN-LINE PRINTER WITH MANUAL POSITIONABLE MECHANICALLY INTERLOCKED MULTIPLE PRINT HEAD ASSEMBLIES

(75) Inventors: Paul R. Sette, Branford; Richard A. Sloan, Jr., Southbury, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/716,982

(22) Filed: Nov. 20, 2000

(51) Int. Cl.[7] ..... B41J 2/21
(52) U.S. Cl. ..... 347/37; 400/82
(58) Field of Search ..... 347/14, 19, 37, 347/101, 42, 43, 40, 172, 49; 400/82, 279, 56, 630, 642

(56) References Cited

U.S. PATENT DOCUMENTS 5,192,141 * 3/1993 Chung et al. ..... 400/56
5,428,375 * 6/1995 Simon et al. ..... 347/12
5,670,995 * 9/1997 Kupcho et al. ..... 347/5
6,139,206 * 10/2000 Ahn ..... 400/323

* cited by examiner

*Primary Examiner*—Anh T. N. Vo
(74) *Attorney, Agent, or Firm*—Ronald Reichman; Michael E. Melton

(57) ABSTRACT

A method and a printer for printing on a substrate with a plurality of print head assemblies, wherein each assembly includes at least one print head. The printer includes a roller assembly to move the substrate towards the print head assemblies along a feed path, which is substantially perpendicular to the width of the substrate. A movable fence is used to adjust the width of the feed path according to the width of the substrate. A linking arm is used to mechanically couple the print head assemblies with pivot action. The moveable fence is used to manually move the print head assemblies relative to each other via the linking arm in order to properly place the print head assemblies over the width of the feed path.

11 Claims, 2 Drawing Sheets

IN-LINE PRINTER WITH MANUAL POSITIONABLE MECHANICALLY INTERLOCKED MULTIPLE PRINT HEAD ASSEMBLIES

CROSS REFERENCE TO RELATED APPLICATIONS

Reference is made to application Ser. No. 09/716,979, entitled IN-LINE PRINTER WITH AUTOMATIC POSITIONING MULTIPLE MICROPROCESSOR CONTROLLED PRINT HEADS, assigned to the assignee of this application and filed on even date herewith.

Reference is made to application Ser. No. 09/716,978, entitled MULTIPLE INLINE PRINT HEAD WITH SERVO DRIVEN MECHANICAL INTERLOCKED PRINT HEAD ASEMBLIES, assigned to the assignee of this application and filed on even date herewith.

TECHNICAL FIELD

The present invention relates generally to in-line printers and deals more specifically with an in-line printer having manual positioning multiple assemblies of print heads.

BACKGROUND OF THE INVENTION

In-line configured printers are important because they minimize the length (along the substrate or printing medium) of the print zone, and thereby minimize the overall envelope of the printing machine. Accommodating a longer print zone expands the overall printing machine envelope which is critical to cost, weight, installation space, inventory and shipping. In-line printers, particularly in-line printers for printing indicia, return address, destination address and/or destination barcode together with optional message line and/or destination barcode on a substrate such as a mail piece, use multiple spaced assemblies of print heads to carry out the required printing.

The positioning of the print head assemblies in such in-line printers is typically accomplished by manual movement of the individual assemblies with respect to one another in those in-line printers that have movable print head assemblies and after such manual movement to the desired location are then locked in a fixed location. The position of the various areas of information to be printed are located relative to one another with variable spacing depending upon the width of the printing medium material, such as, for example, a print stock postal card, an envelope such as a #10 business envelope, a 10-inch×13-inch flat mailing envelope or custom-sized envelope, to be printed. In such in-line printers, a first multiple print head assembly is located to print in a fixed print area of the substrate as the substrate passes relative to the print head. The first multiple print head assembly may be manually aligned and located to print in a fixed print area that, for example, may be in the print area that includes the return address or other indicia information. A second multiple print head assembly is manually located relative to the first print head assembly and positioned to print in a second print area, which may include, for example, the destination address and/or destination barcode. A third multiple print head assembly is then manually located and positioned relative to the second and first multiple print head assemblies to print in a third print area, which may include, for example, a message line or optional barcode. The location of the first, second and third print areas on a mail piece are within predetermined areas of the mail piece and are typically specified by United States Postal Service standards to accommodate mechanized mail processing for each of the differently sized mail pieces. When a user desires to print with an in-line printer on a differently sized substrate or mail piece, the print head assemblies must be repositioned and located and locked in a different position to meet the location print area requirements for the size of the mail piece being printed.

In-line printers such as those described above require operator intervention to relocate and reposition each of the multiple print heads each and every time a differently sized mail piece is printed. The operation and set-up of such in-line printers is labor intensive and cumbersome and less than satisfactory. In addition, the continual resetting and repositioning of the print head assemblies relative to one another may lead to positional error and requires constant verification that the print head assemblies are positioned and located properly with respect to one another to meet the addressing standards for the given size mail piece.

Accordingly, it would be desirable and advantageous to provide an in-line printer having multiple print head assemblies that move together and are automatically positioned relative to one another to accommodate different width substrates to print on each of the desired print areas as the substrate and print head assemblies move relative to one another to print in each of the predetermined print areas of a mail piece.

SUMMARY OF THE INVENTION

The present invention substantially obviates, if not entirely eliminates, the disadvantages and shortcomings of in-line printers having multiple spaced-apart individual print head assemblies that require positioning relative to one another to print in predetermined print areas on a substrate such as a mail piece. The invention accomplishes this by providing an in-line printer having a plurality of multiple print head assemblies coupled to a linking mechanism and which mechanism is manually movable to properly cover the width of the substrate.

The first aspect of the present invention is an in-line printer for printing on a substrate. The in-line printer comprises several elements. These include: a means for registering one edge of the substrate; a plurality of print head assemblies, each assembly including at least one print head; a first moving mechanism capable of moving the substrate towards the print head assemblies along a feed path in a feed direction, which is substantially perpendicular to the width of the substrate; a linking mechanism for linking the print head assemblies in order to simultaneously place the print head assemblies over a distance relative to the substrate edge registering means; and a second moving mechanism for manually moving the print head assemblies relative to each other via said linking mechanism in a moving direction substantially parallel to the width of the substrate.

The in-line printer further comprises a movable fence for guiding the substrate along the feed path, wherein the movable fence is capable of adjusting a width of the feed path according to the width of the substrate, wherein the linking mechanism is coupled to the fence so that the print head assemblies are placed according to the width of the feed path.

Additionally, the in-line printer further comprises a plurality of guide rails, oriented in a direction substantially parallel to the width of the substrate, for slidably mounting the print head assemblies so as to allow the print head assemblies to move relative to each other along the moving direction. In a preferred embodiment, each print head assembly has a pin and the linking mechanism has a linking arm including thereon an aperture and at least one slot, wherein the aperture and the slot are engaged with the pins for controlling the placement of the print head assemblies. Further, one of the print head assemblies is fixedly mounted relative to the substrate edge registering means.

A second aspect of the present invention is a method of in-line printing for printing on a substrate material within a plurality of printing bands, wherein the substrate material has a width and wherein the printing bands are distributed in a predetermined manner over the width. The method comprises several steps, which include: registering one edge of the substrate material; feeding the substrate material from a feed area into a print area along a feed direction substantially perpendicular to the width of the substrate; providing a plurality of print head assemblies in the print area; linking the print head assemblies in order to simultaneously place the print head assemblies over a distance relative to the substrate edge registering means; and moving the print head assemblies manually relative to each other via the linking means along a moving direction substantially perpendicular to the feed direction in order to place the print head assemblies over the printing bands.

The present invention will become more apparent from an understanding of the following detailed description of a preferred embodiment of the present invention when considered in conjunction with the accompanying drawings.

DETAILED DESCRIPTION

Figure 1:
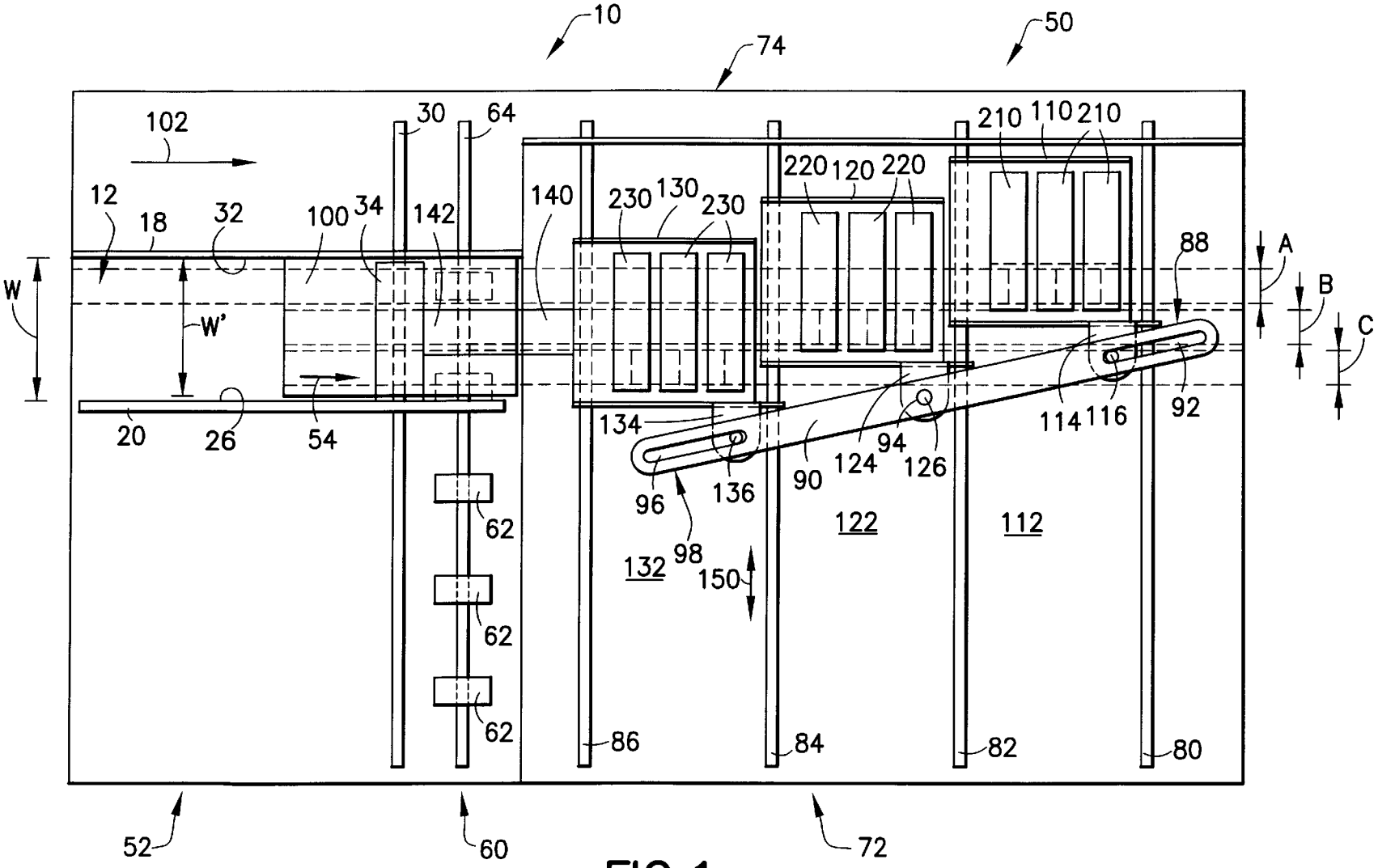
FIG. 1 is a diagrammatic representation illustrating an in-line printer having a linking mechanism embodying the present invention for placing the print head assemblies for printing on a small substrate.
Figure 2:
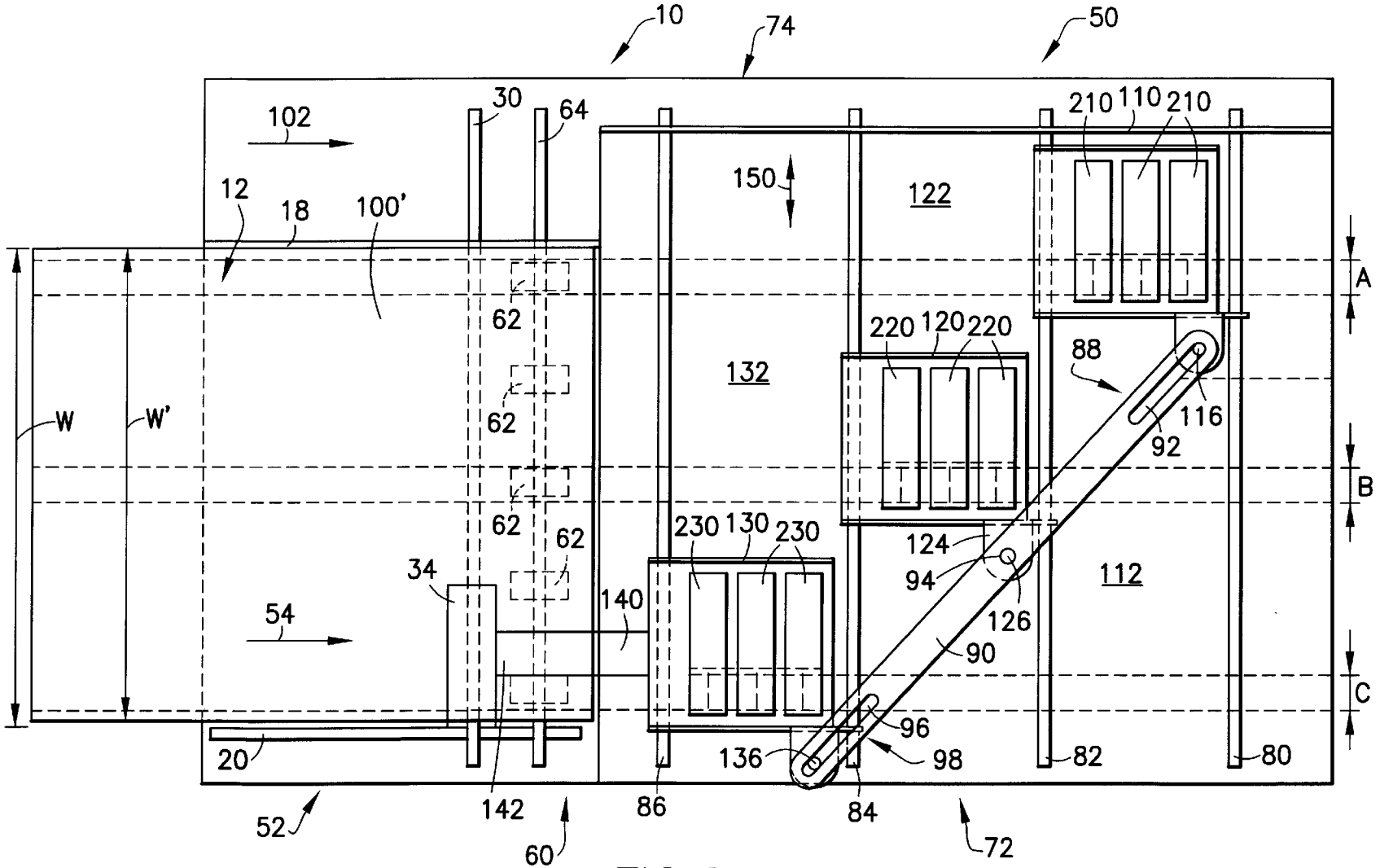
FIG 2 is a diagrammatic representation illustrating an in-line printer having a linking mechanism embodying the present invention for placing the print head assemblies for printing on a large substrate.

Turning now to the drawings and considering the present invention in further detail, an in-line printer having a linking mechanism for placing print head assemblies for printing on substrates is shown as a diagrammatic representation in FIGS. 1 and 2 and is designated generally 10. The in-line printer 10 includes a material bin, generally designated 12, for holding the substrate or printing medium to be fed to the printer for printing, and which substrate material is generally designated 100 in FIG. 1. The substrate material 100 may be mail pieces such as envelopes of various sizes, large flat envelopes, postal cards, or other printing medium as required. The bin 12 includes a fixed wall 18 that is used for registration of one edge of the substrate material as will become apparent from the description below. An adjustable substrate material fence 20 is movable in a direction transverse to the substrate material feed direction shown by direction arrow 102. The adjustable substrate material fence 20 is slidably mounted via a slide assembly 34 on a guide rail 30 for movement into contact with the edge of the substrate material at the fence end 26 opposite the fixed wall end 32 so that the substrate material 100 to be fed and printed upon is stacked and held between the fixed wall 18 and the adjustable substrate material fence 20. The adjustable substrate material fence 20 is movable transverse to the feed direction 102 of the substrate material 100 being fed to the in-line printer 10 to accommodate different sized substrate material as illustrated by the position of the adjustable fence 20 shown in FIG. 2.

A plurality of print heads are used for printing indicia, the return address, the destination address or barcode, optional message line or other text and graphics as required. A substrate material feed roller assembly, generally designated 60, feeds the substrate material 100 one at a time, in accordance with any of a number of ways well known to those in the substrate feeding art, into a print head area generally designated 72. The in-line printer 10 preferably has means for accessing the print head assemblies for maintenance and/or replacement of the ink cartridges, calibration, home position adjustment, etc. It will be understood that the in-line printer 10 illustrated in FIGS. 1 and 2 is generically representative of one type of in-line printer machine that may be used with the present invention.

A diagrammatic representation of a top view of a feeding/printing area is illustrated in FIGS. 1 and 2 and generally designated 50. The feeding/printing area 50 includes a material feed area generally designated 52 that cooperates with the material bin 12 where the substrate material 100 or printing medium to be fed and printed upon is stacked for feeding to the in-line printer. As shown, the adjustable material fence 20 can be slidably moved along the guide rail 30 closer to the fixed wall 18 or away from the fixed wall 18 to accommodate the different widths W' of the substrate material 100. The fixed wall 18 is used to register one edge of the substrate material. The substrate material feed roller assembly 60 includes a number of spaced-apart feed rollers 62 which are mounted on a roller drive shaft 64 mounted transverse to the direction of substrate material feed direction 102. The roller drive shaft 64 can be rotated by a gear belt or other drive means well known to those skilled in the art of substrate material feed assemblies. The material feed roller assembly 60 is driven in a timed manner to feed the substrate material 100 along a feed path 54 into the print head area 72 to and past one or more print zones each having one print head assembly and wherein each print head assembly has at least one print head. As shown in FIGS. 1 and 2, print head assemblies 110, 120 and 130 are, respectively, located in print zones 112, 122 and 132. The print head assembly 110 has three print heads 210 capable of printing on a swath or band A. Likewise, the print head assembly 120 has three print heads 220, capable of printing on a swath or band B, and the print head assembly 130 has three print heads 230, capable of printing on swath or band C. A linking arm 90 has an aperture 94 and two slots 92, 96, one at each end region 88, 98, respectively, to provide mechanical coupling to the print head assemblies 110, 120 and 130. A plurality of parallel guide rails 80, 82, 84 and 86 are used to slidably mount the print head assemblies 110, 120 and 130, allowing some or all of these print head assemblies to move along a rectilinear path in a direction 300 which is substantially perpendicular to the feed direction 102. For example, the print head assembly 130 has a plate 134 including a pin 136 to engage with the slot 96. Likewise, the print head assembly 120 has a plate 124 including a pin 126 to engage with the aperture 94, and the print head assembly 110 has a plate 114 having a pin 116 which is used to engage with the slot 92. The print head assembly 130 has a connecting plate 140 which extends from the assembly 130 in a direction toward the adjustable substrate material fence 20 and has its end 142 opposite the assembly 130 attached to the material fence slide assembly 34. The adjustable substrate material fence 20 is used to move the print head assembly 130 along the guide rail 86 via the connection plate 140 connecting the fence 20 to the assembly 130. Preferably, the print head assembly 110 is fixedly mounted so that the print heads 210 are used to cover the swath or band A which is in the region of the substrate edge closest to the fixed wall 18. When the print head assembly 130 is moved by the adjustable fence 20 along the moving direction 300, the print head assembly 120 will also be moved along the same direction by the linking arm 90 with the pivot action at the pins 116, 126 and 136. Thus, the adjustable fence 20 moves the print head assemblies 110, 120 and 130 relative to each other along the moving direction 300, and the linking arm 90 simultaneously places the print head assemblies 110,120 and 130 in the print head area 72.

FIG. 1 illustrates the placement of the print head assemblies 110, 120 and 130 when a small substrate 100 is fed through the feed path 54 for printing. As shown, the material fence 20 has been moved towards the fixed wall 18 so that the width W of the feed path 54 is substantially equal to the width W' of the substrate 100. In this case, the print head assemblies 120, 130 are moved towards the left edge 74 of the feeding/printing area 50 and the fixed print head assembly 110 so that the print swaths or bands A, B and C are properly spaced relative to one another and evenly cover the width W' of the substrate 100. In FIG. 1, the width W' of the substrate is about 3 inches (7.62 cm), for example.

When printing a large substrate, such as the substrate 100' shown in FIG. 2, the adjustable substrate material fence 20 must be moved away from the fixed wall 18 in order to widen the feed path 54 so that the width W of the feed path is substantially equal to the width W' of the substrate 100'. With the large substrate 100', it is possible to space the print head assemblies apart along the direction 150 away from the left edge 74 and the fixed print head assembly 110. In FIG. 2, the width W' of the substrate is about 10 inches (25.4 cm), for example.

For purposes of this disclosure, the substrate material 100 is shown with a first fixed print area or band generally designated as swath A, in which typically the return address or other indicia information is printed. A second print area or band, generally designated as swath B, contains the destination address and destination barcode if one is so used. A third or bottom print area or band, generally designated as swath C, is used to print a message line or optional barcode. The location of the three print areas or bands are predetermined and set in accordance with the standards set by the United States Postal Service.

Each of the print heads includes one or more ink-jet nozzles. The nozzles can be arranged to form a stepped or staircase-like arrangement whereby a greater surface area can be printed in the print area as the substrate material is moved from the feed area to the print head assemblies. The ink-jet nozzles of the print heads are operated and controlled via the control software in a manner well known to those skilled in the art of ink jet printing to deposit or not deposit ink on the substrate surface as the substrate moves relative to the print head assemblies as required to generate the desired text, graphics or other indicia within the designated print areas. Typically, the ink is black although any color can be used.

In some instances, it is also desirable to print a second color within the designated print areas. In that case, it is possible to use one or more multi-color ink cartridges in each print head assembly. It is also possible to use a number of different, single color ink cartridges in a print head assembly.

As can be appreciated by those skilled in the printer art, a number of variations of the subject invention are possible. These variations include, but are not limited to, the number of print areas controllable on the substrate, the number of successive print head assemblies that may be utilized, the addition of sensors to the adjustable material fence for detecting the leading and trailing edges of a substrate and the variations in the substrate material feed bin and feeding mechanisms to the printer.

It is to be understood that the present invention is not to be considered as limited to the specific embodiments described above and shown in the accompanying drawings, which merely illustrate the best mode presently contemplated for carrying out the invention and which is susceptible to such changes as may be obvious to one skilled in the printing art, but rather that the invention is intended to cover all such variations, modifications and equivalents thereof as may be deemed to be within the scope of the claims appended hereto.

What is claimed is:

1. An in-line printer for printing on a substrate having a width, said in-line printer comprising:

(a) registration means for registering one edge of the substrate;

(b) a plurality of print head assemblies, each assembly including at least one print head;

(c) a first moving mechanism capable of moving the substrate towards the print head assemblies along a feed path in a feed direction substantially perpendicular to the width of the substrate;

(d) a linking mechanism for linking the plurality of the print head assemblies in order to simultaneously place the print head assemblies over a distance relative to the substrate edge registering means; and (e) a second moving mechanism for manually moving the print head assemblies relative to each other via said linking mechanism in a moving direction substantially parallel to the width of the substrate.

2. The in-line printer of claim 1, further comprising a fence for guiding the substrate along the feed path, wherein said fence is capable of adjusting a width of the feed path according to the width of the substrate, wherein the linking mechanism is coupled to the fence so that the print head assemblies are placed according to the width of the feed path.

3. The in-line printer of claim 2, wherein the substrate edge registering means further comprises a fixed wall at one side of the substrate feed path substantially opposite the other side of the width of the feed path defined by a position of the adjustable substrate material fence.

4. The in-line printer of claim 1, further comprising a plurality of guide rails oriented in a direction substantially parallel to the width of the substrate, for slidably mounting the print head assemblies so as to allow the print head assemblies to move relative to each other along the moving direction.

5. The in-line printer of claim 1 further comprising at least one guide rail oriented in a direction substantially parallel to the width of the substrate for slidably mounting the adjustable substrate material fence so as to allow the fence to move toward and away from the fixed wall.

6. The in-line printer of claim 1, wherein the second moving mechanism comprises the adjustable substrate material fence.

7. The in-line printer of claim 1, wherein the first moving mechanism comprises a plurality of rollers.

8. The in-line printer of claim 1, wherein each print head assembly has a pin and the linking mechanism has a linking arm including an aperture and at least one slot, and wherein the aperture and the slot are engaged with the pins for controlling a placement of the print head assemblies.

9. The in-line printer of claim 1, wherein one of the print head assemblies is fixedly mounted relative to the second moving mechanism.

10. A method for printing on a substrate material within a plurality of printing bands, wherein the substrate material has a width and wherein the printing bands are distributed in a predetermined manner over the width, said method comprising the steps of:

(a) registering one edge of the substrate material;

(b) feeding the substrate material from a feed area into a print area along a feed direction substantially perpendicular to the width;

(c) providing a plurality of print head assemblies in the print area;

(d) linking the print head assemblies mechanically in order to simultaneously place the print head assemblies over a distance; and (e) moving the print head assemblies relative to each other via linking means along a moving direction substantially perpendicular to the feed direction in order to place the print head assemblies over the printing bands.

11. The method of claim 10, wherein the step of moving the print head assemblies further comprises providing an adjustable substrate material fence for adjusting the width of the substrate feed path to substantially the width of the substrate to properly place the print head assemblies over the printing bands.

* * * * *